US006783291B2

(12) United States Patent
Tsuchiya et al.

(10) Patent No.: US 6,783,291 B2
(45) Date of Patent: Aug. 31, 2004

(54) PRINTER

(75) Inventors: Masahiro Tsuchiya, Shinagawa (JP); Hiromi Ohtsuka, Shinagawa (JP); Fumio Sakurai, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 0 days.

(21) Appl. No.: 10/446,737

(22) Filed: May 29, 2003

(65) Prior Publication Data

US 2004/0037606 A1 Feb. 26, 2004

(30) Foreign Application Priority Data

Aug. 20, 2002 (JP) ..... 2002-239290

(51) Int. Cl.[7] ..... B41J 15/02

(52) U.S. Cl. ..... 400/621; 346/24; 101/227; 83/477.2; 83/485

(58) Field of Search ..... 400/621, 613, 400/621.1, 88, 693; 101/227, 288; 346/29, 136, 24; 83/477, 477.1, 477.2, 485, 487

(56) References Cited

U.S. PATENT DOCUMENTS 4,663,638 A * 5/1987 Hirose ..... 346/24
5,791,796 A * 8/1998 Gustavsson et al. ..... 400/693
5,839,840 A * 11/1998 Kawano ..... 400/621
5,846,005 A * 12/1998 Britz et al. ..... 400/621
6,155,731 A * 12/2000 Bertalan et al. ..... 400/621
6,203,223 B1 * 3/2001 Nakayama et al. ..... 400/621
6,343,884 B1 * 2/2002 Watanabe et al. ..... 400/621
6,394,674 B2 * 5/2002 Huggins et al. ..... 400/88
6,443,645 B1 * 9/2002 Takei et al. ..... 400/621
6,454,475 B2 * 9/2002 Giles et al. ..... 400/621
6,491,459 B2 * 12/2002 Hosomi ..... 400/693
6,508,600 B1 * 1/2003 Nonaka ..... 400/621
6,511,240 B2 * 1/2003 Yamada ..... 400/613

FOREIGN PATENT DOCUMENTS

JP 5-63855 8/1993

* cited by examiner

*Primary Examiner*—Eugene H. Eickholt
(74) *Attorney, Agent, or Firm*—Staas & Halsey LLP

(57) ABSTRACT

A printer using a roll of paper having an easy structure and ease of maintenance.

A bottom plate (10*a*) of a printer body unit (10) is attached to a bottom plate (31) of a connecting member (30). At the side wall (32) of the connecting member, a cutter unit (20) is attached so as to be rotatable around the pivot P. A platen (40) is attached to the cutter unit through a platen support member (50). A print head (12) has a printing surface (12*a*) and a rear surface (12*b*). The printing surface and the rear surface are arranged substantially perpendicular to the bottom plate (10*a*) of the printer body unit. When the printer is not used, the cutter unit is rotated upwardly at about 90 degrees, so that the platen is located on the non-printing surface side of the print head, opposite to a printing surface, with respect to a rear surface of the print head. Thus, the place above the print head becomes widely open, and the maintenance of the print head can be easily operated.

5 Claims, 7 Drawing Sheets

PRINTER

BACKGROUND OF THE INVENTION

1. Field of the Invention

The present invention relates to a printer using a roll of paper.

2. Description of the Related Art

In a printer using a roll of paper, because a print head, especially a thermal head, is pressed against the paper during printing and is heated, it gets dirty easily and requires periodical maintenance. Thus, it is required to achieve easy access to the print head at the time of maintenance, and various types of printers has been developed.

For example, FIG. 6 shows a printer wherein a platen 40 is attached to a roll cover frame 2 which is rotatably attached to a roll holding frame 1 for holding a roll of paper R. Because the platen 40 can be widely separated from the print head 12, the maintenance of the print head becomes easy. However, a stationary blade 21, which cooperates with a movable blade 22, driven by a cutter unit 20, to cut the paper, is also attached to the roll cover frame 2. Thus, there is a problem that the adjustment of the relative positions of the movable blade 22 and the stationary blade 21 to realize favorable cut of the paper is difficult.

Also, as shown in FIG. 7, there is a printer wherein the stationary blade 21 is attached to the cutter unit 20 and the cutter unit 20 can be rotated. In this type of printer, because the stationary blade 21 and the movable blade 22 are attached to the same cutter unit 20, the above mentioned problem that the adjustment of the relative positions of the movable blade 22 and the stationary blade 21 is difficult does not occur. However, in order to separate the platen 40 from the print head 12, at first the cutter unit 20 is rotated to separate the stationary blade 21 from the print head 12, and then, the roll cover frame 2 is rotated to separate the platen 40, that is, two motions are required.

SUMMARY OF THE INVENTION

An object of the present invention resides in providing a printer using a roll of paper having a simple structure wherein a print head can be accessed by a simple operation.

According to the present invention, there is provided a printer using a roll of paper, comprising a printer body unit having at least a print head attached thereto and a cutter unit for cutting the paper printed by the print head, wherein the cutter unit is rotatably attached to the printer body unit, the cutter unit includes a stationary blade and a movable blade which cooperate, above the print head, to cut the paper during the cutting operation, the print head is provided with a platen for pressing the paper against the print head, and the stationary blade, the movable blade and the platen can be displaced from a position above the print head, by rotating the cutter unit.

Preferably, the cutter unit can be rotated to a position in which the platen is located on the non-printing surface side of the print head, opposite to a printing surface, with respect to an extension line of a rear surface of the print head, when the printer is not used.

Preferably, a connecting member is attached to the printer body unit and the cutter unit is rotatably attached to the connecting member.

Preferably, the platen is attached to a lower surface of the cutter unit through a platen mounting member.

Preferably, the platen mounting member can also serve as a paper guide for guiding the paper into the cutter unit.

The present invention may be more fully understood from the description of preferred embodiments of the invention set forth below, together with the accompanying drawings.

DESCRIPTION OF THE PREFERRED EMBODIMENTS

The embodiments of the printer according to the present invention will be explained below, with reference to the attached drawings.

Figure 1:
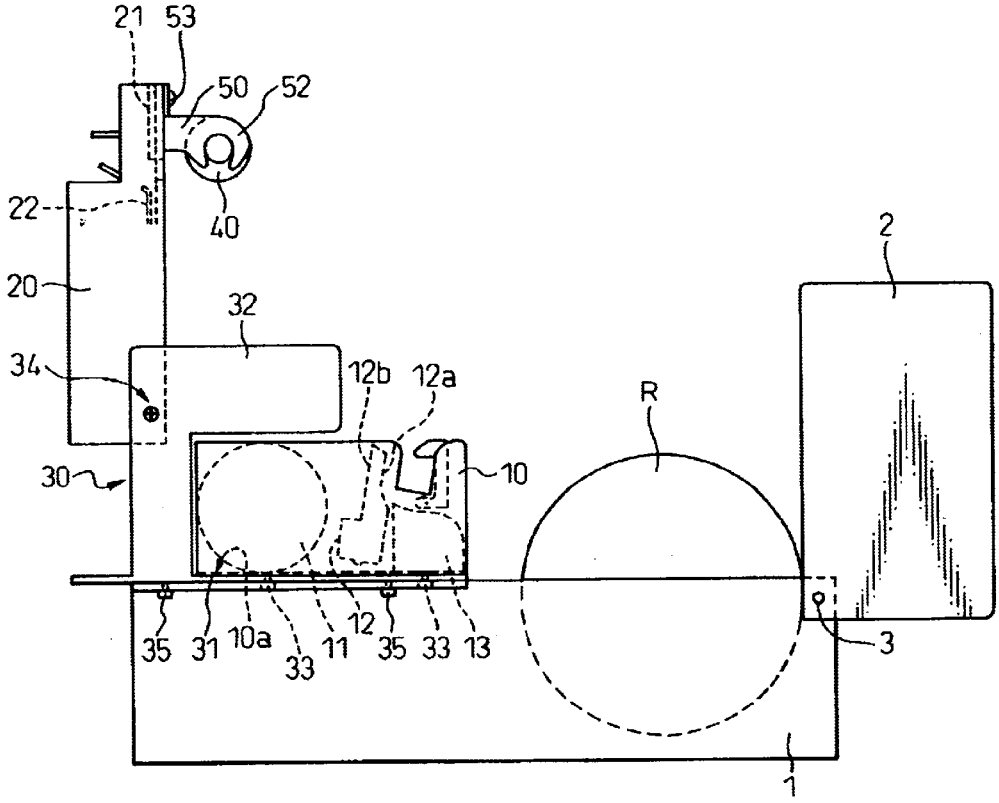
FIG. 1 shows a printer which is in an inoperative position, for maintenance of a print head, in a first embodiment of the present invention.
Figure 2:
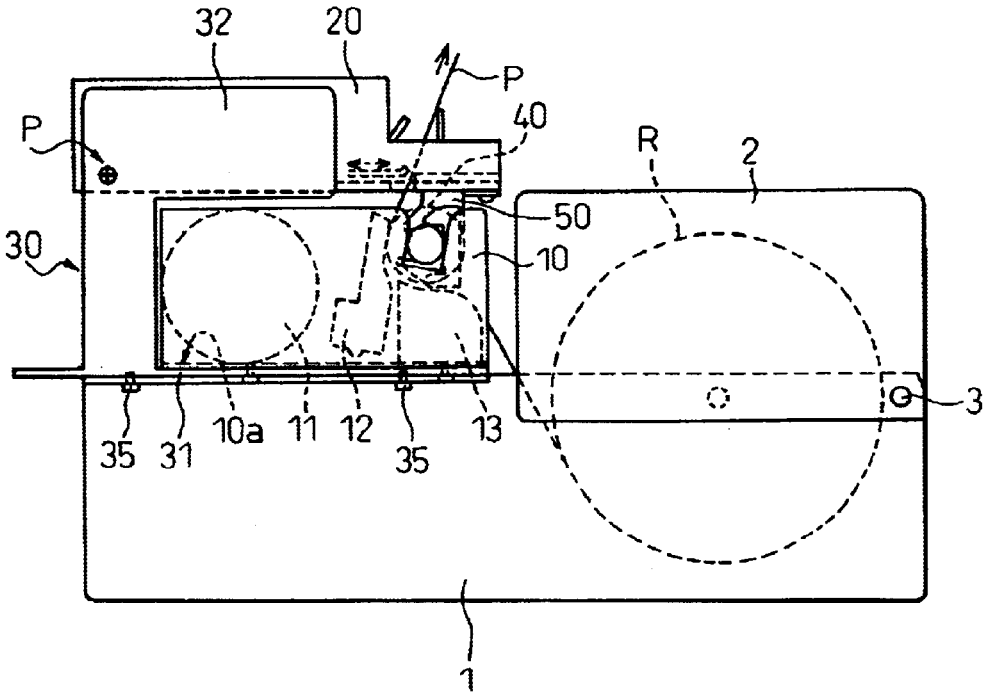
FIG. 2 shows a printer in use in a first embodiment of the present invention.

FIGS. 1 and 2 show a side view of a printer in a first embodiment of the present invention. FIG. 1 shows a situation where the printer is inoperative, that is, the maintenance of the print head 12 is being performed. FIG. 2 shows the printer in use, that is, a printing operation is being performed.

A bottom plate 10*a* of the printer body unit 10 is attached to the bottom plate 31 of the connecting member 30. At the side wall 32 of the connecting member 30, a cutter unit 20 is rotatably attached by a bolt 34. A platen support member 50 is attached to the cutter unit 20 by a bolt 53. A platen 40 is engaged to an arm 52 of the platen support member 50. The connecting member 30, to which the printer body unit 10 and the cutter unit 20 are attached, is attached to a roll holding frame 1 by a bolt 35.

Inside of the printer body unit 10, a driving motor 11, a print head 12 and a paper guide 13 are accommodated. The print head 12 has a printing surface 12*a* and a rear surface 12*b*. The printing surface 12*a* and the rear surface 12*b* are arranged substantially perpendicular to the bottom plate 10*a* of the printer body unit 10.

In the present embodiment, the cutter unit 20 is a so-called guillotine cutter wherein a movable blade 22 is moved toward a stationary blade 21 by a movable blade driving motor (not shown) to cut a paper P with the edges of the both blades. The roll holding frame 1 holds the roll of paper R. A roll cover frame 2 is rotatably attached around a shaft 3 of the roll holding frame 1, and the roll cover frame 2 can be flipped-up at the time of changing the roll of paper R.

Figure 7:
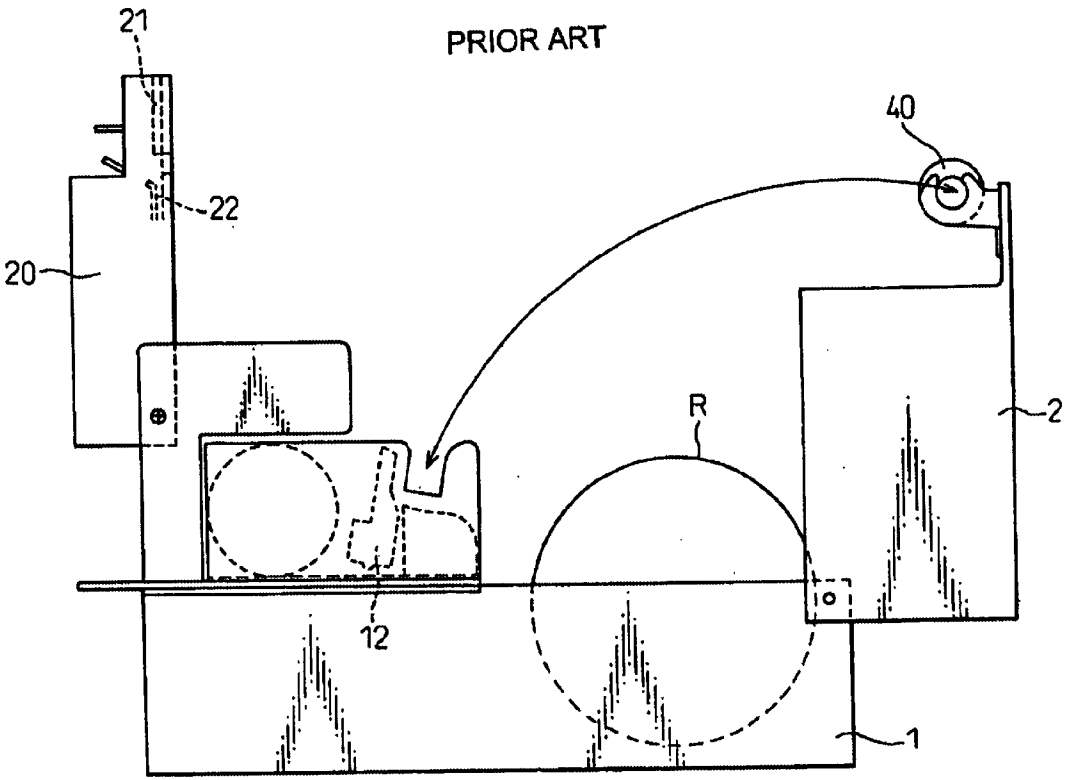
Fig.7 PRIOR ART
FIG. 7 shows another prior art.

As is apparent from the comparison of FIG. 1 and FIG. 2, when the printer is not being used, the cutter unit 20 is rotated at about 90 degrees, with respect to when the printer is being used. The movable blade 22 being substantially horizontal when the printer is used becomes substantially perpendicular when the printer is not being used. When the printer is not used, the platen 40 attached to the cutter unit 20 is located on the non-printing surface side of the print head 12 standing substantially perpendicular, with respect to the rear surface 12*b* of the print head. The portion above the print head 12 is wide open, similar to the prior art shown in FIG. 7, and the access to the print head 12 is easy and maintenance can be easily done. Further, it can be done by only one motion, while two motions are required in the prior art shown in FIG. 7.

Figure 3:
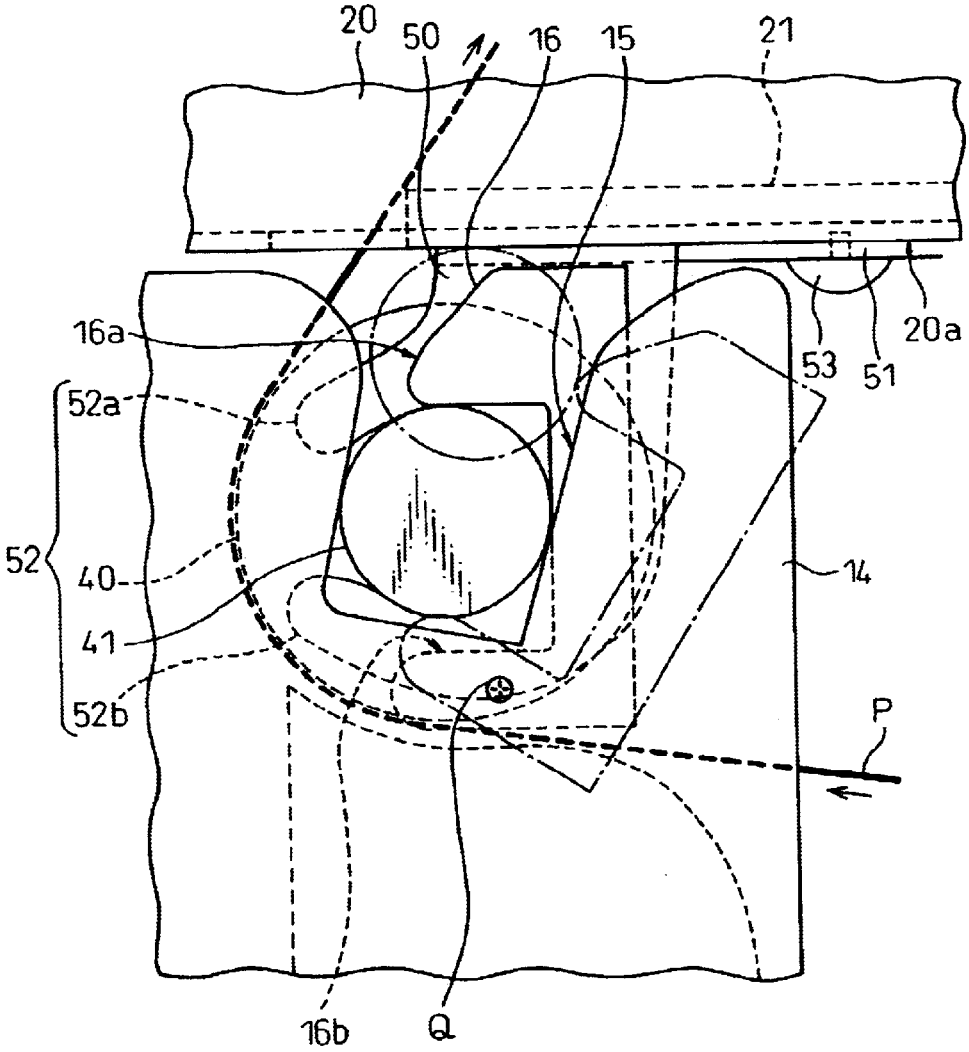
FIG. 3 shows a partial, detailed view of FIG. 2.

FIG. 3 shows an enlarged view around the platen 40 when the printer is being used. An upper plate 51 of a platen mounting member 50 is attached to the bottom plate 20*a* of the cutter unit 20. Arms 52*a* and 52*b*, extending downwardly in the drawing from the upper plate 51, support a shaft 41 of the platen 40. The shaft 41 of the platen 40 projects in a direction perpendicular to the sheet of the drawing, and the projected portion is located within a notch 15 which substantially has a U-shape and is formed at the upper part of the side wall 14 of the printer body unit 10.

The printer body unit 10 is provided with a platen shaft stopper 16 which is generally U-shaped with the left side being open in FIG. 3. The platen shaft stopper 16 is provided so as to be rotatable clockwise around the pivot Q from the position shown by a solid line and a dotted line in the drawing, and is always forced counterclockwise toward the position, shown by the solid line and the dotted line, by a spring (not shown).

Accordingly, when the platen shaft 41 is lowered from above toward the notch 15 of the printer body unit 10 so as to be located within the notch 15, as shown by an alternate long and short dash line in the drawing, the platen shaft 41 pushes the upper arm 16*a* of the platen shaft stopper 16 to rotate the platen shaft stopper 16 clockwise. When the platen shaft 41 passes the upper arm 16*a* of the platen shaft stopper 16, the platen shaft stopper 16 returns to the position shown by the solid line and the dotted line so as to prevent the platen shaft 41 from moving upward.

The platen shaft stopper 16 is provided with a lever (not shown). Upon removing the platen 40 from the printer body unit 10, the lever is manually operated to rotate the platen shaft stopper 16 clockwise. Then, the platen shaft stopper 16 can be separated from the platen shaft 41.

Figure 4:
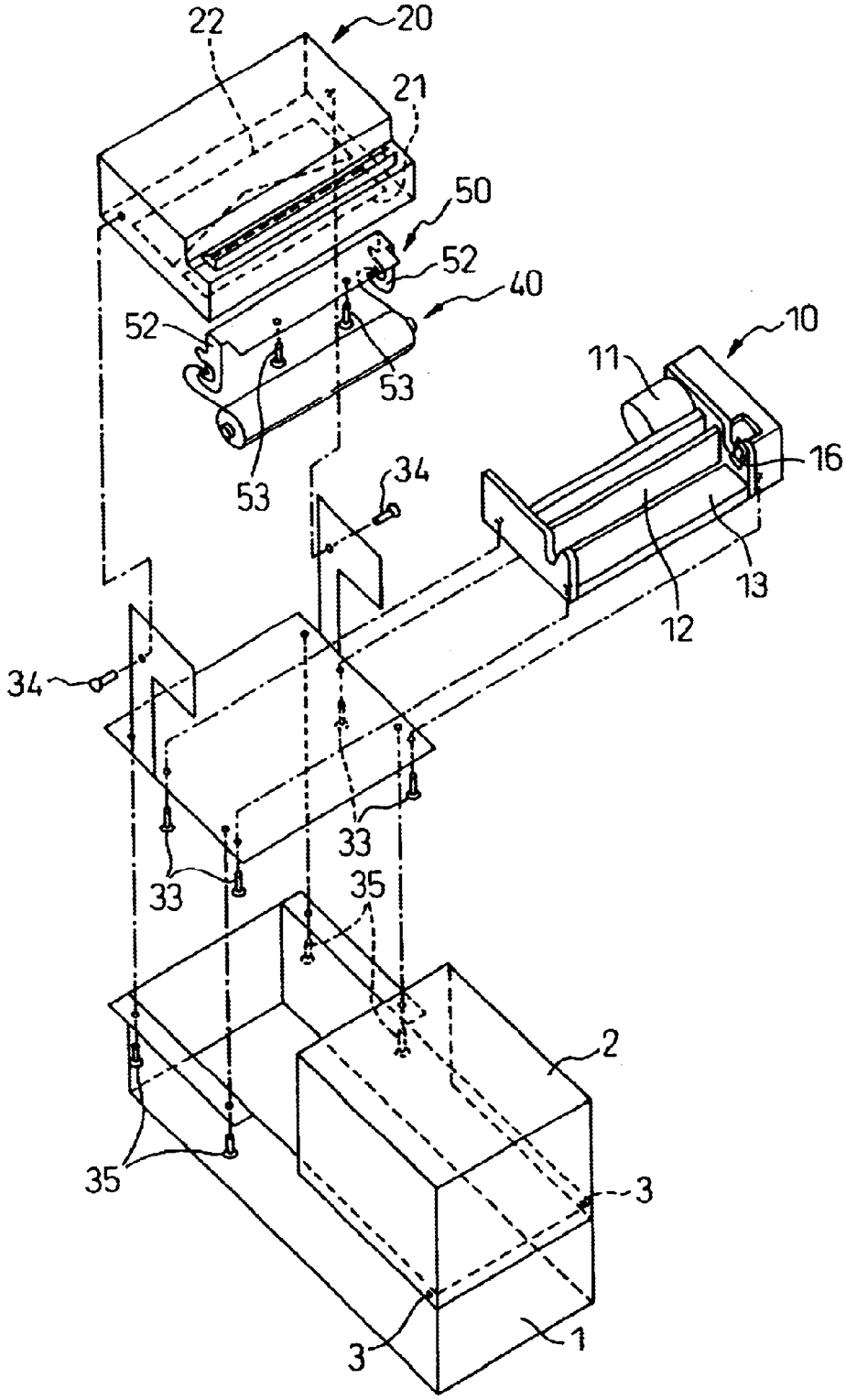
FIG. 4 shows an exploded view of a first embodiment.

Next, the assembly of the printer according to the first embodiment, as structured and used above, will be explained with reference to an exploded view shown in FIG. 4.

At first, the platen support member 50 is attached to the cutter unit 20 by the bolt 53. The arm 52 of the platen support member 50, attached to the cutter unit 20, is engaged with the platen 40.

Then, the bottom plate 10*a* of the printer body unit 10 is attached to the bottom plate 31 of the connecting member 30 by the bolt 33. Thereafter, the cutter unit 20, having the platen 40 through the platen support member 50, is rotatably provided on the side wall 32 of the connecting member 30. Then, the connecting member 30 having the printer body unit 10 and the cutter unit 20 is attached to the roll holding frame 1, to complete the assembly.

Because the present invention according to the first embodiment is assembled as described above, and if, for example, the printer body unit 10, the cutter unit 20 and the platen 40 have already been obtained as discrete components, only the connecting member 30, the platen mounting member 50 for mounting the platen 40 to the cutter unit 20, are newly required. Thus, less cost is required fro design changes.

Figure 5:
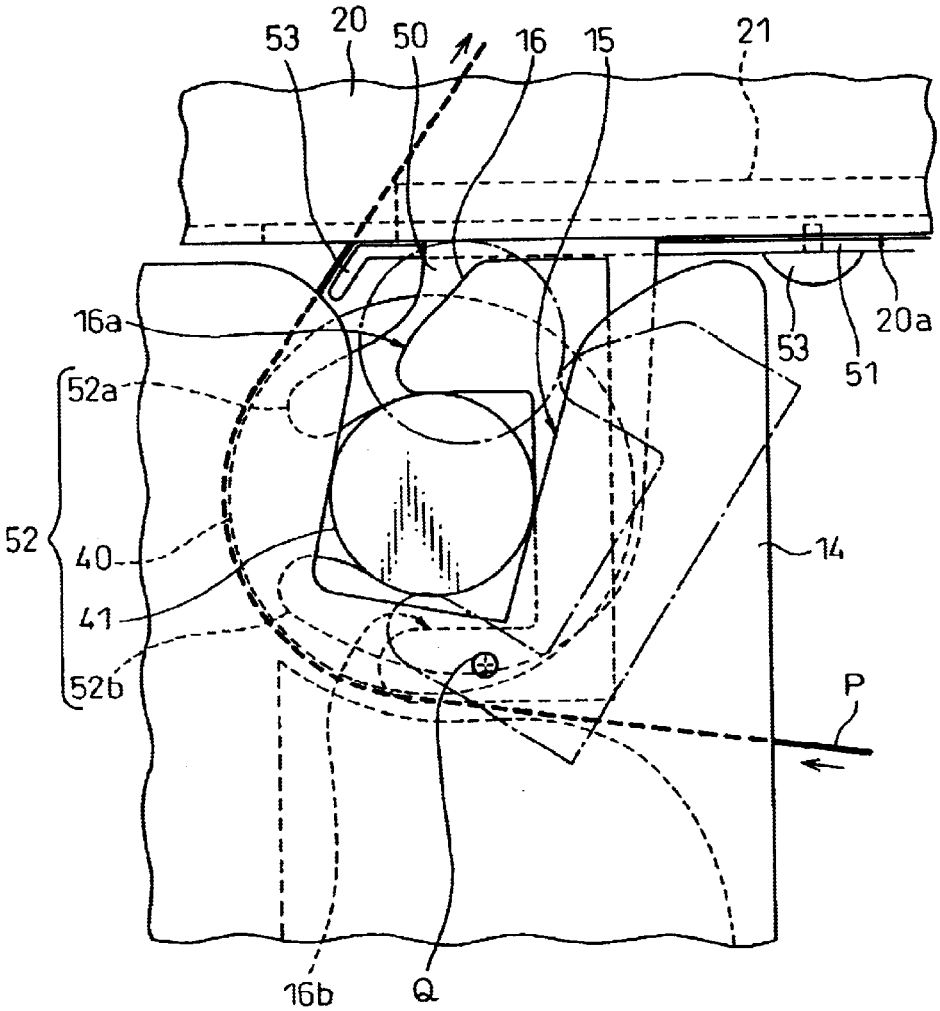
FIG. 5 is an explanatory view of a second embodiment.
Figure 6:
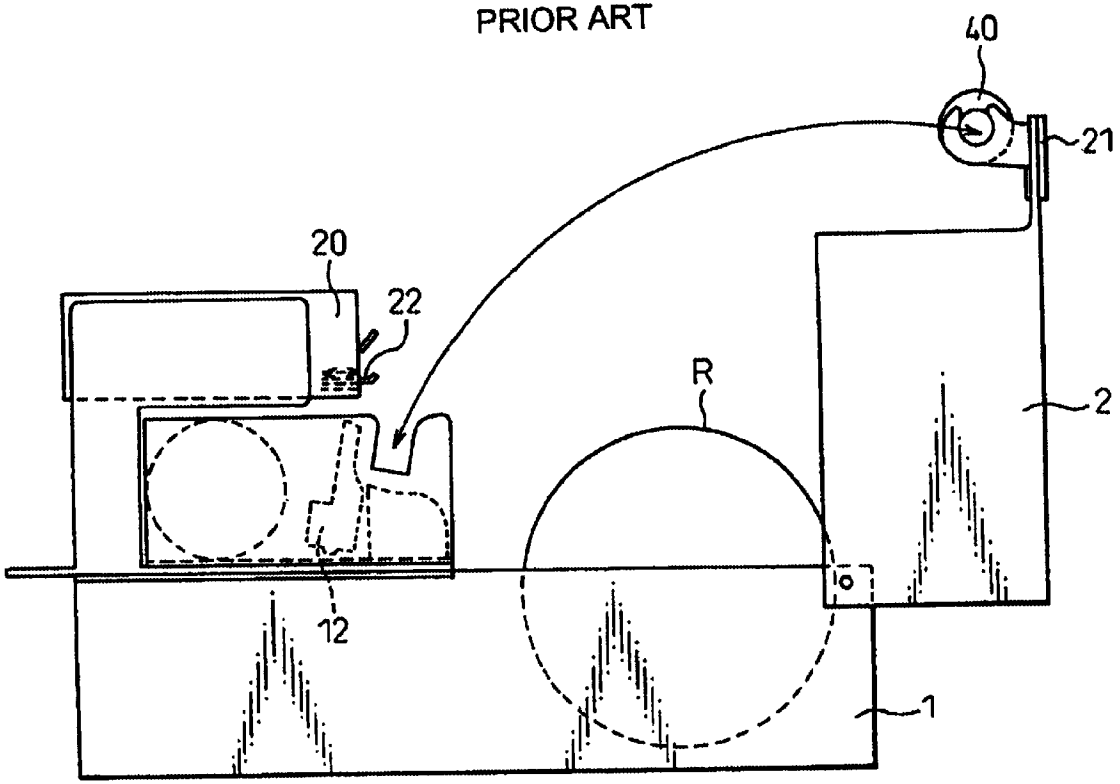
Fig. 6 PRIOR ART
FIG. 6 shows a prior art.

Next, the second embodiment will be explained. FIG. 5 is an explanatory view of the features of the second embodiment. The second embodiment is different from the first embodiment in the point that the upper plate 51 of the platen mounting member 50 extends toward the left, in the drawing, and, then, bend downward so as to form a paper guide 53. By doing this, entanglement of the paper P after printing can be prevented at little cost.

A printer using a roll of paper according to the present invention comprises a printer body unit having at least a print head attached thereto and a cutter unit for cutting the paper printed by the print head, wherein the cutter unit is rotatably attached to the printer body unit, the cutter unit includes a stationary blade and a movable blade which cooperate, near the print head, to cut the paper, during the cutting operation, the print head is provided with a platen for pressing the paper against the print head, and the stationary blade, the movable blade and the platen can be displaced from a position above the print head, by rotating the cutter unit. Accordingly, when the printer is not used, the place above print head is widely open and the maintenance can be easy.

What is claimed is:

1. A printer using a roll of paper, comprising a printer body unit having at least a print head attached thereto and a cutter unit for cutting the paper printed by the print head, wherein the cutter unit is rotatably attached to the printer body unit, the cutter unit includes a stationary blade and a movable blade which cooperate, above the print head, to cut the paper during the cutting operation, the print head is provided with a platen for pressing the paper against the print head, and the stationary blade, the movable blade and the platen can be displaced from a position above the print head, by rotating the cutter unit.

2. A printer using a roll of paper according to claim 1, wherein when the printer is not being used, the cutter unit can be rotated to a position in which the platen is located on the non-printing surface side of the print head, opposite to a printing surface, with respect to an extension line of a rear surface of the print head.

3. A printer using a roll of paper according to claim 1, wherein a connecting member is attached to the printer body unit and the cutter unit is rotatably attached to the connecting member.

4. A printer using a roll of paper according to claim 1, wherein the platen is attached to a lower surface of the cutter unit through a platen mounting member.

5. A printer using a roll of paper according to claim 4, wherein the platen mounting member can also serve as a paper guide for guiding the paper into the cutter unit.

* * * * *

UNITED STATES PATENT AND TRADEMARK OFFICE

CERTIFICATE OF CORRECTION

PATENT NO. : 6,783,291 B2
DATED : August 31, 2004
INVENTOR(S) : Masahiro Tsuchiya et al.

It is certified that error appears in the above-identified patent and that said Letters Patent is hereby corrected as shown below:

Column 4,
Line 35, change “print head” to -- cutter unit --

Signed and Sealed this

First Day of February, 2005

JON W. DUDAS
*Director of the United States Patent and Trademark Office*